US007150672B2

(12) United States Patent
Mizuno

(10) Patent No.: US 7,150,672 B2
(45) Date of Patent: Dec. 19, 2006

(54) CUP ATTACHING APPARATUS

(75) Inventor: Toshiaki Mizuno, Aichi (JP)

(73) Assignee: Nidek Co., Ltd., Aichi (JP)

( * ) Notice: Subject to any disclaimer, the term of this patent is extended or adjusted under 35 U.S.C. 154(b) by 596 days.

(21) Appl. No.: 10/103,825

(22) Filed: Mar. 25, 2002

(65) Prior Publication Data

US 2002/0144516 A1 Oct. 10, 2002

(30) Foreign Application Priority Data

Mar. 26, 2001 (JP) ..... P2001-087108

(51) Int. Cl.

| | |
|---|---|
| ***B24B 1/00*** | (2006.01) |
| ***B24B 7/19*** | (2006.01) |
| ***B24B 7/30*** | (2006.01) |
| ***B24B 41/06*** | (2006.01) |
| ***B24B 49/00*** | (2006.01) |
| ***B24B 51/00*** | (2006.01) |

(52) U.S. Cl. ..... 451/5; 451/460; 451/42; 451/388; 451/384; 451/390

(58) Field of Classification Search ..... 451/460, 451/388, 390, 384, 42

See application file for complete search history.

(56) References Cited

U.S. PATENT DOCUMENTS

| | | | | |
|---|---|---|---|---|
| 1,415,560 | A * | 5/1922 | Hill | 451/460 |
| 1,494,333 | A * | 5/1924 | Bausch | 451/460 |
| 2,381,573 | A * | 8/1945 | Canning | 451/460 |
| 2,660,011 | A * | 11/1953 | Bernheim et al. | 451/460 |
| 3,033,466 | A * | 5/1962 | Sorensen | 239/32 |
| 3,277,612 | A * | 10/1966 | Brandt | 451/460 |
| 3,507,076 | A * | 4/1970 | Rudd et al. | 451/460 |
| 3,951,203 | A * | 4/1976 | Prunier | 164/334 |
| 4,288,946 | A * | 9/1981 | Bicskei | 451/43 |
| 4,543,752 | A * | 10/1985 | Kotting | 451/460 |
| 5,283,980 | A * | 2/1994 | Lohrenz et al. | 451/5 |
| 5,425,665 | A * | 6/1995 | Kennedy | 451/5 |
| 6,168,505 | B1 | 1/2001 | Gottschald | |

FOREIGN PATENT DOCUMENTS

| | | |
|---|---|---|
| DE | 1 235 180 | 2/1967 |
| DE | 198 25 922 A1 | 12/1999 |
| EP | 0409760 A1 | 1/1991 |
| EP | 0 601 742 A1 | 6/1994 |
| EP | 0 947 287 A2 | 10/1999 |

* cited by examiner

*Primary Examiner*—Joseph J. Hail, III
*Assistant Examiner*—Bryan R. Muller
(74) *Attorney, Agent, or Firm*—Sughrue Mion, PLLC

(57) ABSTRACT

A cup attaching apparatus for attaching a cup, used during processing of an eye glass lens, to the lens, the apparatus includes: a placing portion onto which the lens is placed; a holding portion for detachably holding the cup; a supporting portion for supporting the holding portion; a moving mechanism for moving the supporting portion in an optical axis direction of the placed lens; and a pressure regulating mechanism for preventing a cup attaching force from exceeding a predetermined pressure.

4 Claims, 5 Drawing Sheets

CUP ATTACHING APPARATUS

BACKGROUND OF THE INVENTION

The present invention relates to a cup attaching apparatus for attaching a cup used during the processing of an eyeglass lens to a subject lens.

As a preliminary operation before a subject lens is processed by a lens processing apparatus, a cup used during processing is attached to the lens by a cup attaching apparatus called an aligner or blocker. The cup attaching apparatus of the following type is available. A lens to which a mark is applied onto its optical center or the like using a lens meter is illuminated so that an image of the lens is projected onto a screen, and a cup attaching position is aligned by observing an image of the mark projected onto the screen and a reference scale. In such an apparatus, after the alignment of the lens is completed, an arm to which the cup has been attached in advance is manually pushed down to allow the cup to be pressed against the lens and suckingly fixed to the lens.

However, in the case of a lens coated with a reflection preventing film (anti-reflection film) or the like, the conventional cup attaching apparatus causes a problem in that if the force with which the cup is attached is too strong (too large), the lens is deformed and the coating is cracked. In addition, with the apparatus in which the arm is manually operated, since there are individual differences in the force with which the arm is pushed down to attach the cup, there are variations due to the difference in the operator.

SUMMARY OF THE INVENTION

In view of the above-described problems, it is An object of the present invention to provide a cup attaching apparatus which makes it possible to prevent an excess force (more than is necessary) from being applied to the subject lens and to attach the cup to the lens with a stable force.

To attain the above object, the present invention is characterized by having the following features.

(1) A cup attaching apparatus for attaching a cup, used during processing of an eyeglass lens, to the lens, the apparatus comprising:

a placing portion onto which the lens is placed;

a holding portion for detachably holding the cup;

a supporting portion for supporting the holding portion;

a moving mechanism for moving the supporting portion in an optical axis direction of the placed lens; and pressure regulating means for preventing a cup attaching force from exceeding a predetermined pressure.

(2) The apparatus of (1), wherein the pressure regulating means includes sensing means for sensing a state that pressure exceeding the predetermined pressure is applied to the placed lens.

(3) The apparatus of (1), wherein:

the moving mechanism includes a pressing portion that is movable relative to the supporting portion in the optical axis direction of the placed lens and to which pressing force for moving the supporting portion in the optical axis direction of the placed lens is applied; and the pressure regulating means includes a deformable member that is provided between the pressing portion and the supporting portion and that is deformed when pressing force exceeding the predetermined pressure is applied to the pressing portion.

(4) The apparatus of (3), wherein the pressure regulating means includes adjusting means for adjusting an initial deforming force of the deformable member.

(5) The apparatus of (1), wherein:

the holding portion is supported by the supporting portion to be movable in the optical axis direction of the placed lens;

the moving mechanism includes a pressing portion to which pressing force for moving the supporting portion in the optical axis direction of the placed lens is applied; and the pressure regulating means includes a deformable member that is provided between the supporting portion and the holding portion and that is deformed when pressing force exceeding the predetermined pressure is applied to the pressing portion.

(6) The apparatus of (5), wherein the pressure regulating means includes adjusting means for adjusting an initial deforming force of the deformable member.

(7) The apparatus of (1), wherein:

the moving mechanism includes a motor for moving the supporting portion in the optical axis direction of the placed lens; and pressure regulating means includes control means for controlling driving of the motor.

(8) The apparatus of (7), wherein:

the pressure regulating means includes detecting means for detecting a drive load of the motor; and the control means controls driving of the motor based on a result of detection by the detecting means.

(9) The apparatus of (7), wherein:

the pressure regulating means includes setting means for variably setting the cup attaching force; and the control means controls driving of the motor based on the set cup attaching force.

(10) A cup attaching apparatus for attaching a cup, used during processing of an eyeglass lens, to the lens, the apparatus comprising:

a placing portion onto which the lens is placed;

a holding portion for detachably holding the cup;

a supporting portion for supporting the holding portion;

a pressing portion that is movable relative to the supporting portion in an optical axis direction of the placed lens, and to which pressing force for moving the supporting portion in the optical axis direction of the placed lens is applied; and a deformable member that is provided between the pressing portion and the supporting portion and that is deformed when pressing force exceeding a predetermined pressure is applied to the pressing portion.

(11) The apparatus of (10), further comprising:

an adjusting member for adjusting an initial deforming force of the deformable member.

(12) A cup attaching apparatus for attaching a cup, used during processing of an eyeglass lens, to the lens, the apparatus comprising:

a placing portion onto which the lens is placed;

a holding portion for detachably holding the cup;

a supporting portion for supporting the holding portion to be movable in an optical axis direction of the placed lens;

a pressing portion to which pressing force for moving the supporting portion in the optical axis direction of the placed lens is applied; and a deformable member that is provided between the supporting portion and the holding portion and that is deformed when pressing force exceeding a predetermined pressure is applied to the pressing portion.

(13) The apparatus of (12), further comprising:

an adjusting member for adjusting an initial deforming force of the deformable member.

The present disclosure relates to the subject matter contained in Japanese patent application No. 2001-87108 (filed on Mar. 26, 2001), which is expressly incorporated herein by reference in its entirety.

DESCRIPTION OF THE PREFERRED EMBODIMENT

Figure 1B:
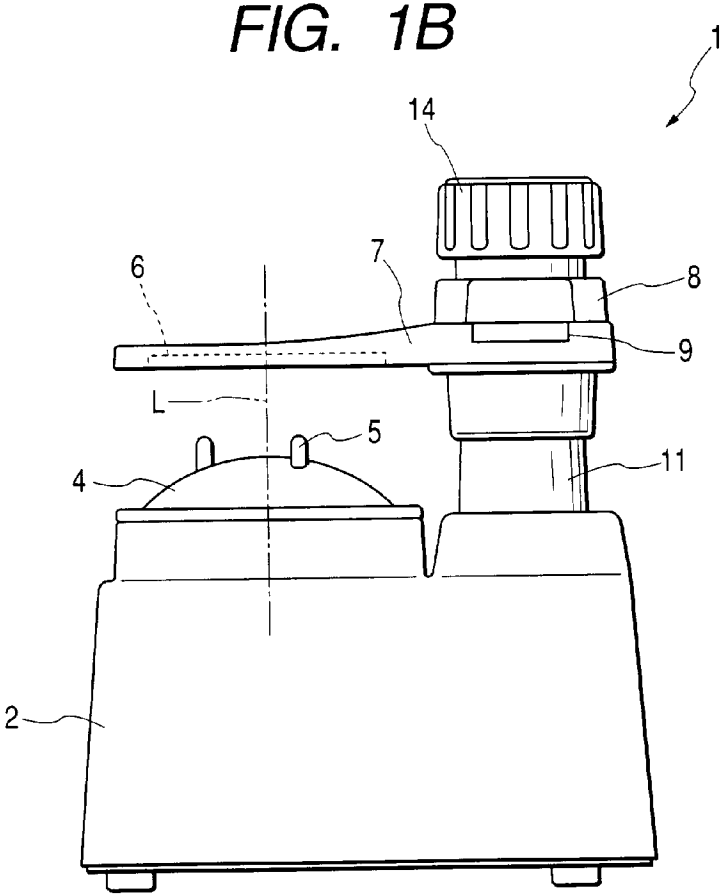
FIGS. 1A and 1B are external views of a cup attaching apparatus in accordance with a first embodiment.
Figure 1A:
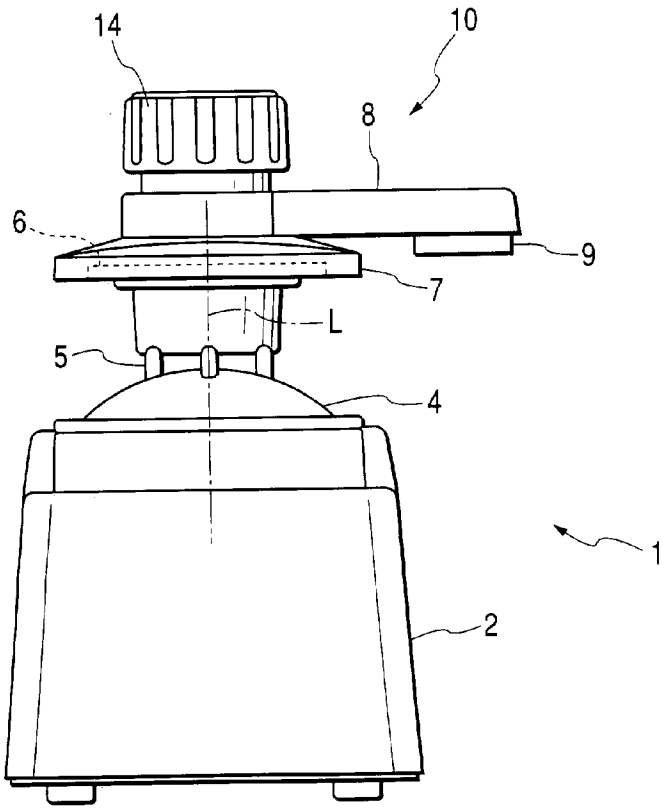
Figure 2:
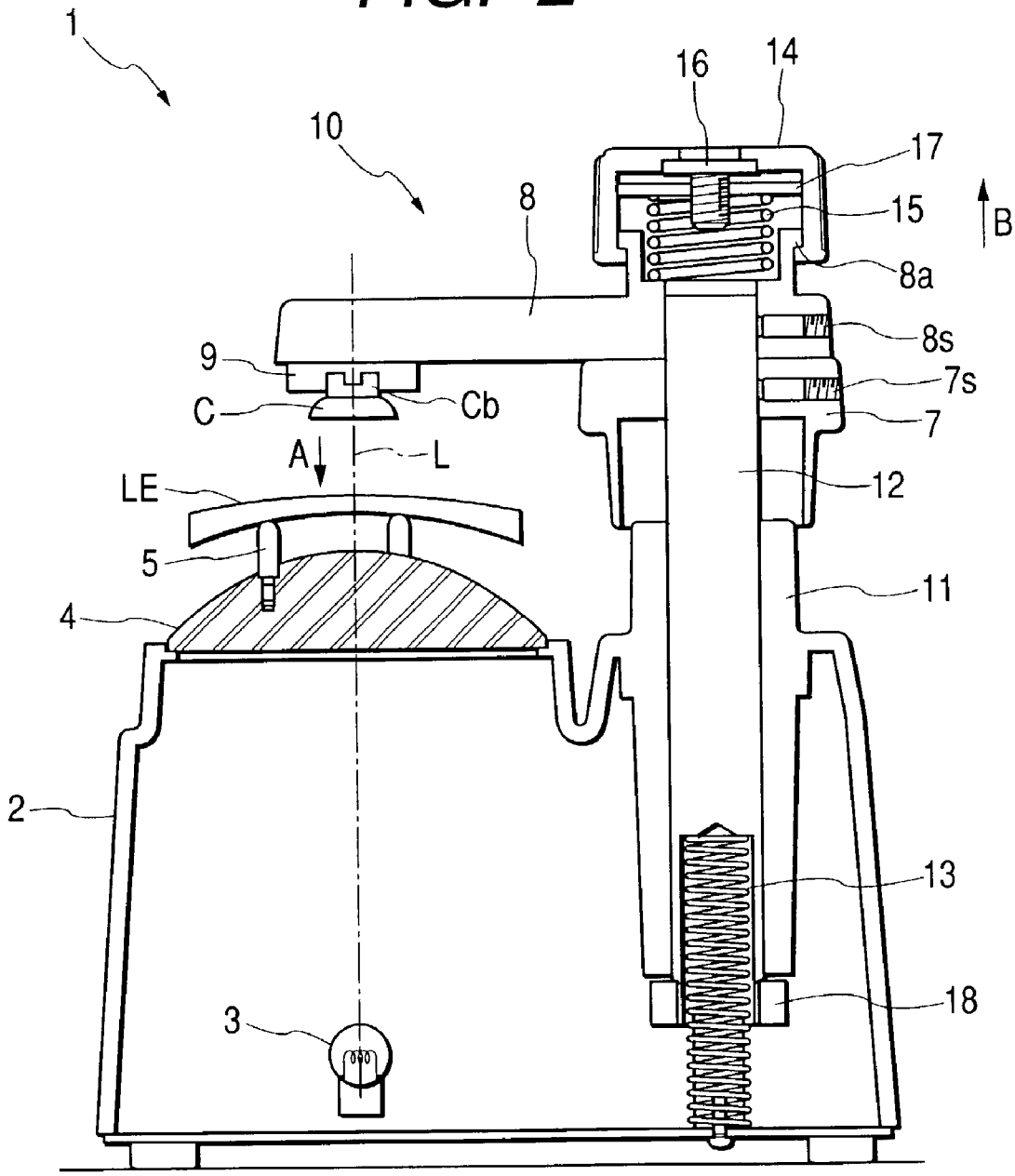
FIG. 2 is a side elevational view of the interior of the cup attaching apparatus.
Figure 3:
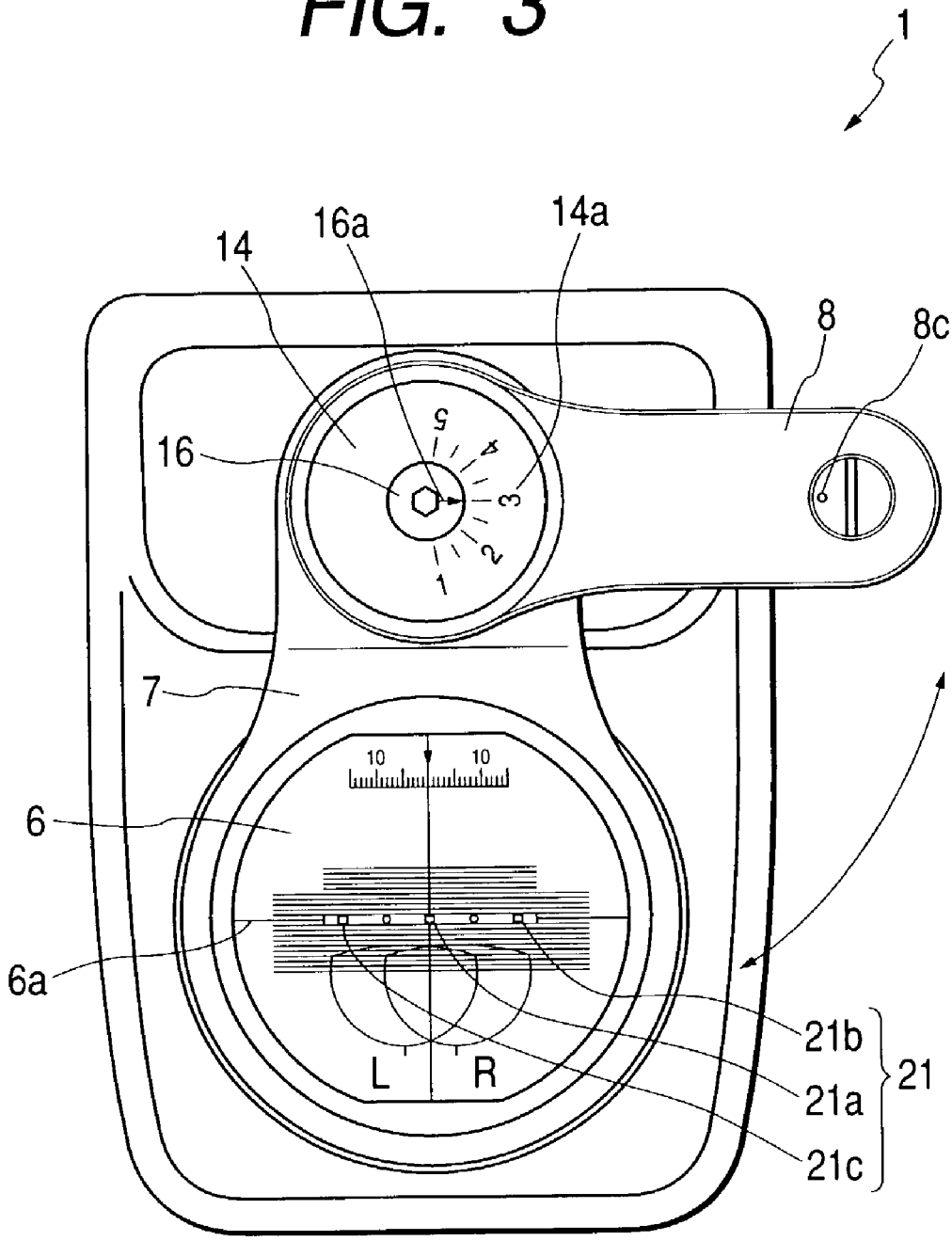
FIG. 3 is a top view of the cup attaching apparatus.

Referring now to the drawings, a description will be given of the embodiments of the invention. FIGS. 1A and 1B are external views of a cup attaching apparatus 1 in accordance with a first embodiment of the invention, in which FIG. 1A is a front elevational view, and FIG. 1B is a side elevational view. FIG. 2 is a side elevational view of the interior of the apparatus 1, and FIG. 3 is a top view of the apparatus 1. It should be noted that FIGS. 1A, 1B, and 3 are diagrams in a case where a screen plate 6 is positioned on a reference axis L, and FIG. 2 is a diagram in a case where a cup fitting portion 9 is positioned on the reference axis L.

In FIGS. 1A, 1B, and 2, reference character L denotes a reference axis for cup attachment (alignment) . An illuminating light source 3 located on the reference axis L is provided inside a main body housing 2, and a condenser lens 4 is disposed on top of the main body housing 2. The lens 4 collimates the illumination light from the light source 3 into a parallel beam of light. Three lens receiving pins 5 onto which a subject lens LE is placed are disposed on an upper surface of the lens 4 with the reference axis L as a center. It should be noted that the number of the pins 5 is not limited to three, and may be any arbitrary number that can stably place the lens LE on the pins 5 (such that the optical axis of the lens LE becomes substantially parallel with the reference axis L). Furthermore, tubular members may be used instead of the pins.

A cylindrical portion 11 is integrally formed in the rear of the main body housing 2, and a shaft 12 constituting a part of a cup attaching portion 10 is held inside this cylindrical portion 11 in such a manner as to be movable vertically in the direction of the reference axis L and to be rotatable. The shaft 12 is constantly urged upward (in the direction of arrow B in FIG. 2) which is an opposite direction to a cup attaching direction (in the direction of arrow A in FIG. 2) by means of a spring 13 provided between the shaft 12 and a bottom surface of the main body housing 2. Namely, the spring 13 has an urging force for lifting the shaft 12, as shown in FIG. 2, against the load of the cup attaching portion 10 provided on an upper portion of the shaft 12. Reference numeral 18 denotes a removal preventing member for ensuring that the shaft 12 is prevented from being removed upward by the urging force of the spring 13, and the removal preventing member 18 is attached to a lower end of the shaft 12.

The arm 7 for holding the screen plate 6 and an arm 8 for supporting the cup fitting portion (cup holding portion) 9 for holding a cup C are fixed to an upper portion of the shaft 12 by means of screws 7S and 8S, respectively. The fitting portion 9 to which a proximal portion Cb of the cup C is fitted so as to be held is provided on the underside of a distal end of the arm 8, and the cup C is detachable from the fitting portion 9.

In addition, a rotating knob 14 having a pressing surface which is pressed by an operator in the cup attaching direction (in the direction of arrow A) is provided on an arm upper portion 8*a* which is located on the rotational axis of the shaft 12. An inner surface of the knob 14 is guided by the arm upper portion 8*a*, and the knob 14 is movable vertically in the direction of the reference axis L, and is non-rotatable with respect to the arm 8 by an unillustrated restricting member. As the knob 14 is rotated, the arm 7 and the arm 8, together with the shaft 12, are rotatable 90° from the position shown in FIG. 1 to the position, shown in FIG. 2, where the center of the cup C is aligned with the reference axis L.

A spring 15 is inserted between a recessed portion formed in the arm upper portion 8*a* and the knob 14 so that the knob 14 is constantly urged upward (in the direction of arrow B) and has a structure for preventing the removal of the knob 14 from the arm upper portion 8*a*, as shown in the drawing. The spring 15 has a spring constant greater than that of the spring 13, so that the spring 15 has such a spring force that its urging force is greater than the upwardly urging force of the spring 13 and that the spring 15 is deformed when a pressing force greater than a predetermined pressure is applied thereto by the pressing down of the knob 14.

In addition, a spring-force adjusting screw 16 and a spring presser plate 17 are inserted inside the knob 14. The presser plate 17 is provided with internal threads threadingly engaged with the adjusting screw 16. If the adjusting screw 16 is rotated, the presser plate 17 moves vertically in the direction of the reference axis L, thereby adjusting an initial deforming spring force (the force with which the cup C is attached to the lens LE, i.e., pressing force) of the spring 5. In addition, as shown in FIG. 3, a scale 14*a* for the attaching force is provided on the upper surface of the knob 14, and the value of the scale 14*a* indicated by an arrow 16*a* provided on the upper surface of the adjusting screw 16 is the set attaching force. In case where the attaching force is to be changed, adjustment is made by turning the adjusting screw 16 by using a hexagonal wrench. In this embodiment, the attaching force is made changeable continuously in the range of 1 to 5 kg (may be changeable in a stepwise manner).

A description will be given of the operation of the apparatus constructed as described above. Here, a description will be given of a case where alignment is made with the optical center of the lens LE (the cup C is mounted by aligning its center with the optical center of the lens LE).

First, the operator positions the center of the screen plate on the reference axis L in advance, and fits the cup C to the fitting portion 9. When the cup C is fitted, the proximal portion Cb of the cup C is inserted and fitted in the fitting portion 9 such that the cup C is oriented in a predetermined direction in conformity with a positioning mark 8*c* provided on an upper portion of the distal end of the arm 8. Next, the lens LE with a marked point provided in advance at its optical center by a lens meter or the like is placed on the lens receiving pins 5. At this time, the lens LE is placed stably such that the optical axis of the lens LE and the reference axis L become substantially parallel. The lens LE is illuminated by the illumination light from the light source 3, and its image is projected onto the screen plate 6. Further, as shown in FIG. 3, an image 21 of the marked point provided on the lens LE is aligned with a cross reticle mark 6*a* on the screen plate 6. Namely, a central image 21*a* of the marked point is aligned with the center of the cross reticle mark 6*a*, and in a case where the lens LE has cylindrical power, images 21*b* and 21*c* of the marked point which indicate the axial angle of astigmatism (cylinder) are adjusted so as to be located on the horizontal line of the cross reticle mark 6*a*.

Subsequently, the arm 8 (and the arm 7 as well) is rotated 90° by the knob 14 to align the center of the cup C with the reference axis L, and the upper portion (pressing surface) of the knob 14 is pressed down (in the direction of arrow A). If the knob 14 is pressed down, the spring 13 first undergoes compressive deformation, and the entire movable portions such as the knob 14, the arm 7, the arm 8, and the shaft 12 move downward (in the direction of arrow A) . After the cup C has abutted against the upper surface of the lens LE, if the knob 14 is pressed down, the cup C sucks the lens LE. If the knob 14 is further pressed down, the spring 15 begins to undergo compressive deformation. Even if the operator presses down the knob 14, the arm 8 and the like are not lowered further than that, and the spring 15 absorbs the pressing force (kinetic energy) of the operator attempting to press down the knob 14. At this point of time, the operator senses that the attachment of the cup C has been completed from the manual response, i.e., from the reaction force the time of pressing the knob 14 and its stroke, and the operator weakens (stops) the force for pressing down the knob 14 and finishes the operation.

As the spring 15 undergoes compressive deformation after the cup C has been attached to the upper surface of the lens LE by pressing down the knob 14, it is possible to suppress the pressing force applied to the lens LE by the operator more than is necessary. For this reason, it is possible to prevent a situation in which the lens LE is deformed, and the cracking of the coating such as the reflection preventing film coated on the lens surface occurs.

In addition, it is possible to vary the attaching force with respect to the lens LE by changing the initial deforming force of the spring 15 depending on the material, shape, and type (suction type, seal type, etc.) of the cup C as well as the material and shape of the lens LE and the kind of coating on the lens LE. For this reason, the adjusting screw 16 is rotated with the hexagonal wrench to allow the arrow 16*a* to be directed toward a value to be set on the scale 14*a*.

In addition, in a case where an unskilled operator attaches the cup C to the lens LE, such an operator is unable to grasp the attaching force to be applied. With the mechanism of this apparatus, however, since the attaching force with respect to the lens LE is maintained at a substantially fixed level, the apparatus is particularly effective for unskilled operators.

In addition, even in a case where a skilled operator is busily engaged with the operation and has pressed down the knob 14 abruptly contrary to his or her intention, since the spring 15 absorbs the attaching force applied to the lens LE (pressing force of the knob 14), an excess force is not applied to the lens LE.

Figure 4:
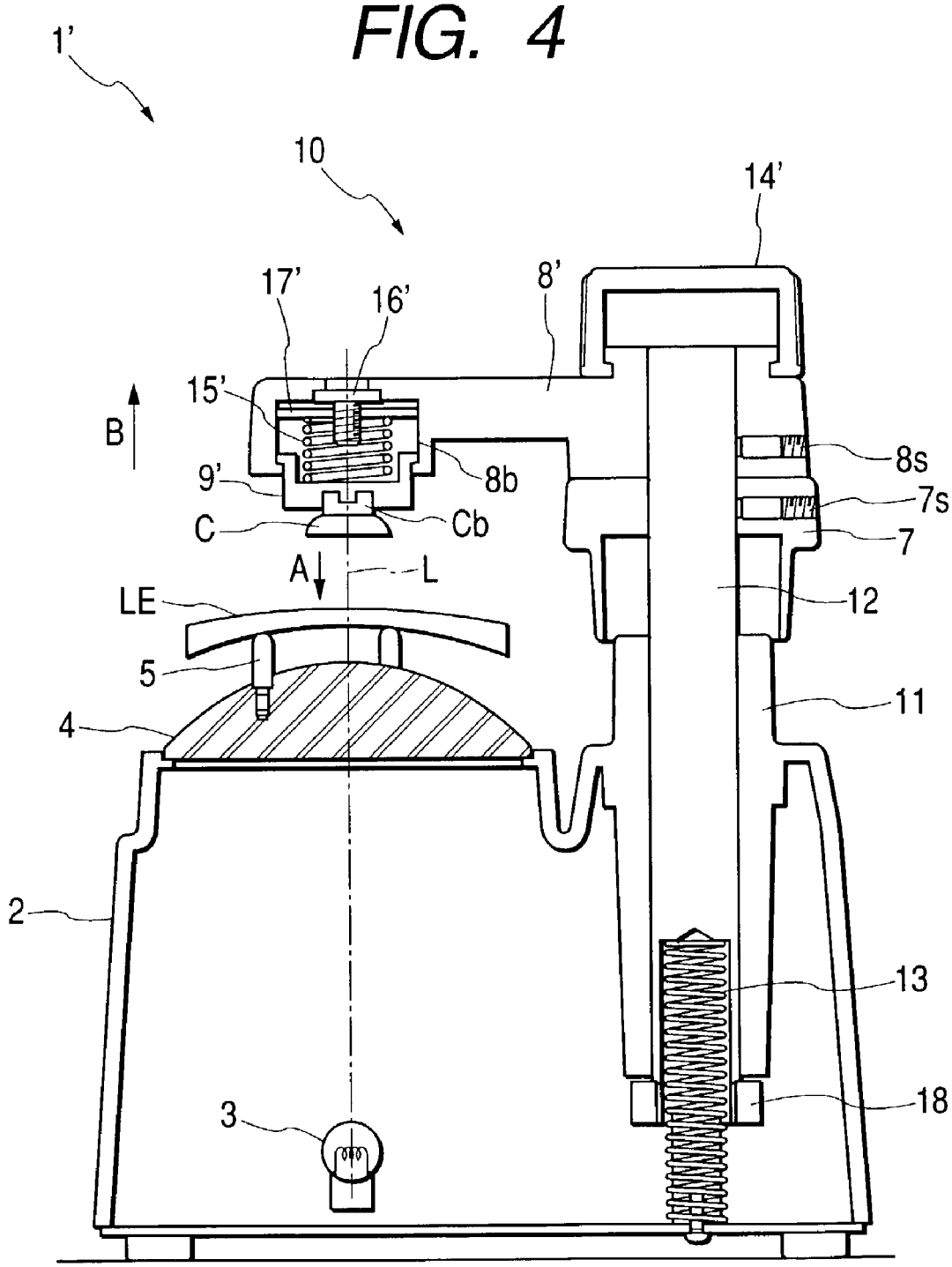
FIG. 4 is a side elevational view of the interior of the cup attaching apparatus in accordance with a second embodiment.

FIG. 4 is a diagram explaining a cup attaching apparatus 1' in accordance with a second embodiment of the invention, and elements identical to those of the preceding embodiment are denoted by the same reference numerals. A fitting portion 9' for detachably holding the cup C is held on the underside of a distal end of an arm 8' in such a manner as to be movable vertically in the direction of the reference axis L and to be non-rotatable. A spring 15' for urging the fitting portion 9' downward (in the direction of arrow A) relative to the arm 8' is provided in a recessed portion 8*b* formed in the distal end of the arm 8'. In the same way as the spring 15 in the preceding embodiment, this spring 15' has such a spring force that its urging force is greater than the upwardly urging force (in the direction of arrow B) of the spring 13 and that the spring 15' is deformed when pressure greater than a predetermined pressure is applied thereto. Further, a spring presser plate 17' for adjusting the initial deforming spring force of the spring 15' as well as a spring-force adjusting screw 16' for moving the spring presser plate 17' vertically in the direction of the reference axis L are provided in the recessed portion 8*b*. It should be noted that, in this embodiment, a rotating knob 14' is fixed to the arm 8'.

In this construction as well, if the knob 14' is pressed down to allow the cup C to suck the lens LE, and the knob 14' is further pressed down, the spring 15' begins to undergo compressive deformation and absorbs the pressing force (kinetic energy) of the operator attempting to press down the knob 14'. Since the operator senses that the attachment of the cup C has been completed from the manual response, i.e., from the reaction force at the time of pressing the knob 14' and its stroke, the operator weakens (stops) the force for pressing down the knob 14' and finishes the operation. Consequently, it is possible to suppress the pressing force applied to the lens LE by the operator more than is necessary.

It should be noted that as for the springs 13 and 15 (15') described in the above-described two embodiments, other deformable resilient members or pneumatic springs may be used. Still alternatively, it is possible to adopt a mechanism in which, instead of the spring 13, a weight and a pulley are used to urge the shaft 12 upward (in the direction of arrow B).

Figure 5:
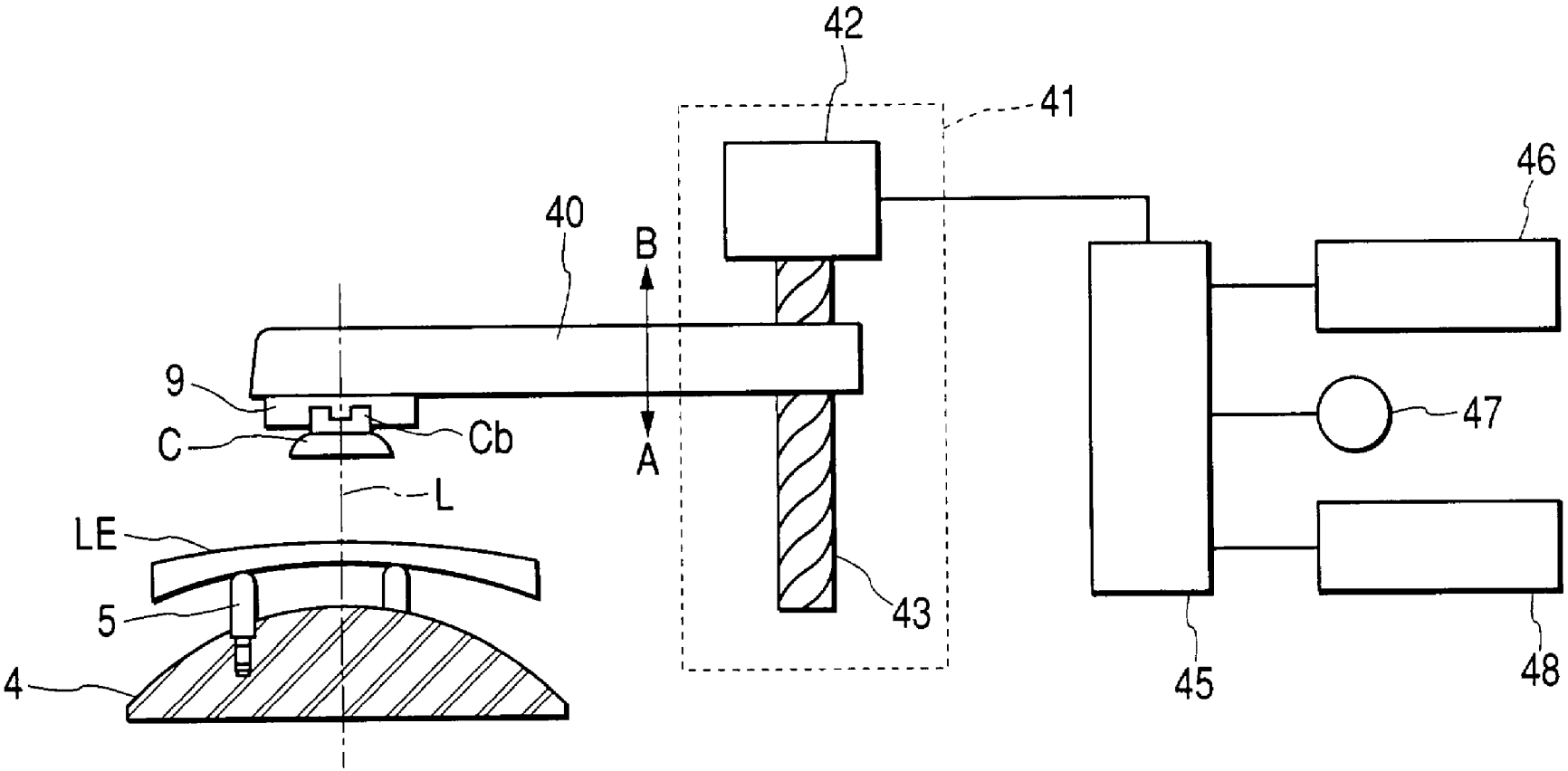
FIG. 5 is a schematic diagram of the cup attaching apparatus in accordance with a third embodiment.

FIG. 5 is a diagram explaining a third embodiment of the invention. Although in each of the above-described embodiments an arrangement is provided to attach the cup by a manual operation, this embodiment shows an example in which the cup is attached by the driving force of a motor.

In the same way as the first embodiment, the cup C is fitted to the fitting portion 9 supported by an arm 40. Reference numeral 41 denotes a moving mechanism section and is constituted by a motor 42, a ball screw 43 attached to a rotating shaft of the motor 42, and the like. As the ball screw 43 is rotated, the arm 40 is moved vertically in the direction of the reference axis L. The driving of the motor 42 is controlled by a control unit 45. Connected to the control unit 45 are an input unit 46 for inputting various conditions, a start switch 47 for starting the cup attachment, and a memory 48. In the input unit 46, the type (suction type, seal type, etc.) of the cup C is inputted. The reason for this is that the attaching force necessary for cup attachment differs depending on the type of cup C. Incidentally, if in addition to the type of cup C there are other conditions for changing the attaching force such as the material and shape of the cup, the material and shape of the lens LE, and the type of coating, these conditions are also inputted.

On the basis of the inputted condition, the control unit 45 reads out the motor driving condition (electric power to be supplied to the motor) registered in advance in the memory 48, and drives the motor 42 to move the arm 40 downward (in the direction of arrow A) . When the motor 42 is driven, the control unit 45 detects the current flowing across the motor 42, and when the detected value of the current has reached a current value set in advance on the basis of the input condition (i.e., when it is detected from the load current applied to the motor 42 that pressure greater than a predetermined pressure is applied to the lens LE), the motor 42 is reversely rotated to move the arm 40 upward (in the direction of arrow B). Consequently, the cup C can be attached without applying an attaching force tore than is necessary to the lens LE.

It should be noted that the attaching force may be changed by inputting a numerical value from the input unit 46. In addition, the attaching portion 9 and the arm 40 may be provided with a spring and a mechanism for changing the spring force in the same way as the preceding embodiments. In this case, a photosensor for detecting the deformation of the spring is provided, and the control unit 45 stops the lowering of the arm 40 in accordance with this detected signal, thereby completing the cup attachment.

As described above, in accordance with the invention, it is possible to prevent an excess force (more than is necessary) from being applied to the subject lens, and to attach the cup to the lens with a stable force.

What is claimed is:

1. A cup attaching apparatus for attaching a cup, used during processing of an eyeglass lens, to the lens, the apparatus comprising:

a cup;

a placing portion onto which the lens is placed;

a holding portion for detachably holding the cup;

a supporting portion for supporting the holding portion;

a moving mechanism for moving the supporting portion in an optical axis direction of the placed lens, the moving mechanism including a pressing portion that is movable relative to the supporting portion in the optical axis direction and to which a pressing force for moving the supporting portion in the optical axis direction is applied; and pressure regulating means for preventing a cup attaching force from exceeding a first predetermined force, the pressure regulating means including a deformable member that is provided between the pressing portion and the supporting portion and that is deformed when the pressing force exceeding a second predetermined force is applied to the pressing portion, and adjusting means for adjusting an initial deforming force of the deformable member.

2. A cup attaching apparatus for attaching a cup, used during processing of an eyeglass lens, to the lens, the apparatus comprising:

a cup;

a placing portion onto which the lens is placed;

a holding portion for detachably holding the cup;

a supporting portion for supporting the holding portion;

a pressing portion that is movable relative to the supporting portion in an optical axis direction of the placed lens, and to which a pressing force for moving the supporting portion in the optical axis direction is applied;

a deformable member that is provided between the pressing portion and the supporting portion and that is deformed when the pressing force exceeding a predetermined pressure is applied to the pressing portion; and an adjusting member for adjusting an initial deforming force of the deformable member.

3. A cup attaching apparatus for attaching a cup, used during processing of an eyeglass lens, to the lens, the apparatus comprising:

a cup;

a placing portion onto which the lens is placed;

a holding portion into which the cup is detachably held;

a supporting shaft which supports the holding portion;

a first spring that is provided under the supporting shaft, the first spring having a first spring force for lifting the supporting shaft in an axis direction of the supporting shaft;

a pressing portion that is provided on the supporting shaft to be movable in the axis direction and to which a pressing force for pressing down the supporting shaft in the axis direction is applied; and a second spring that is provided between the pressing portion and the supporting shaft, the second spring having a second spring force that is larger than the first spring force, for lifting the pressing portion in the axis direction.

4. The apparatus of claim 3, further comprising:

an adjust unit which adjusts the second spring force of the second spring.

* * * * *